United States Patent [19]

Rodriguez et al.

[11] Patent Number: 4,481,861

[45] Date of Patent: Nov. 13, 1984

[54] FIRE ADJUSTMENT DEVICE DESIGNED TO BE MOUNTED ON THE END OF A GUN BARREL

[75] Inventors: José Rodriguez, Castelmourou; Robert Cassanelli, Toulouse, both of France

[73] Assignee: Societe Cassanelli & Cie, Balma, France

[21] Appl. No.: 288,207

[22] Filed: Jul. 29, 1981

[30] Foreign Application Priority Data

Aug. 5, 1980 [FR] France ..... 80 17273

[51] Int. Cl.[3] ..... F41C 21/06

[52] U.S. Cl. ..... 89/41 A; 42/76 R

[58] Field of Search ..... 42/1 R, 76 R; 89/41 A

[56] References Cited

U.S. PATENT DOCUMENTS 661,897 11/1900 Toll ..... 89/41 A
1,341,117 5/1920 Fischer ..... 42/1 R
1,448,587 3/1923 Arntzen ..... 89/41 A
2,469,870 5/1949 Dixon ..... 42/1 R
4,195,432 4/1980 Hickman ..... 89/41 A

FOREIGN PATENT DOCUMENTS 418618 2/1947 Italy ..... 42/76 R

*Primary Examiner*—Stephen C. Bentley
*Attorney, Agent, or Firm*—Cushman, Darby & Cushman

[57] ABSTRACT

The device includes a support frame having a base adapted to be mounted at the end of the gun barrels and two flanges. On the frame two tubes are pivotaly mounted around pivots, having a bore identical to the gun gauge and adjustable by means of micrometer screws so as to change the angle of the bore axle in relation to that of the barrels, thereby obtaining a diverging or converging effect of both tubes and allowing an adjustment of the range of both barrels to meet specific conditions.

6 Claims, 5 Drawing Figures

FIRE ADJUSTMENT DEVICE DESIGNED TO BE MOUNTED ON THE END OF A GUN BARREL

FIELD OF THE INVENTION

This invention relates to a fire adjustment device designed to be mounted at the end of the barrel of a gun and usable on any type of sporting gun, with superimposed or adjacent barrels, and of automatic gun.

SUMMARY OF THE INVENTION

In accordance with one feature of the invention, the device includes a support frame, means to mount said frame at the end of the barrel, and at least a tube adjustably positionned on said frame in alignment with the barrel and having a bore corresponding to the gun gauge, adjusting means allowing the angle of the tube axle to be changed in relation to the barrel axle.

According to another feature of the invention, for twin barrel guns, the device of the invention includes two tubes symmetrically mounted on the support frame.

The device once positionned at the end of the barrel, adjusting the elevation, e.g. by means of micrometer screws acting on either tube at will, causes a diverging or converging effect of both tubes to be obtained, thereby adjusting with a very high accuracy the range of sporting gun or shotgun barrels and therefore allowing the user to obtain for any sort of shooting as well as for any sporting targets the fire adjustment the best adapted thereto.

DETAILED DESCRIPTION OF THE PREFERRED EMBODIMENT

These and further advantages of the invention will be more readily understood when the following description is read in connection with the appended drawings, wherein.

Figure 1:
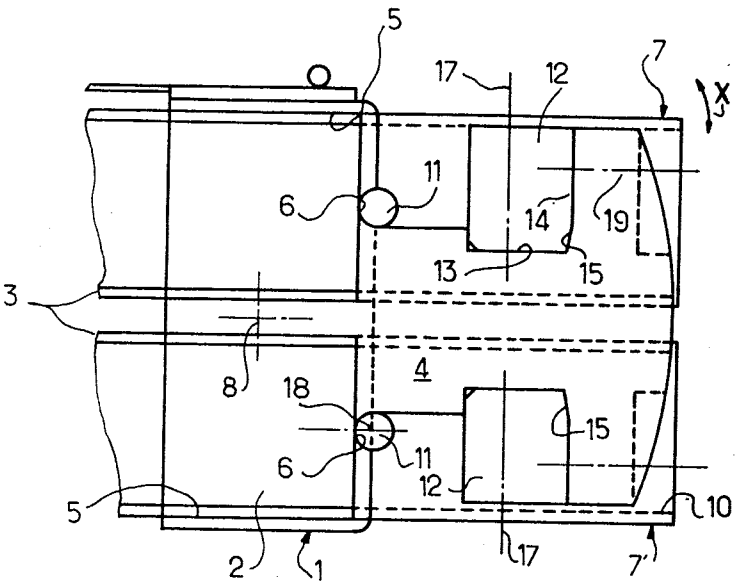
FIG. 1 is a side elevational view of the device of the invention, assembled at the end of a twin barrel gun.
Figure 2:
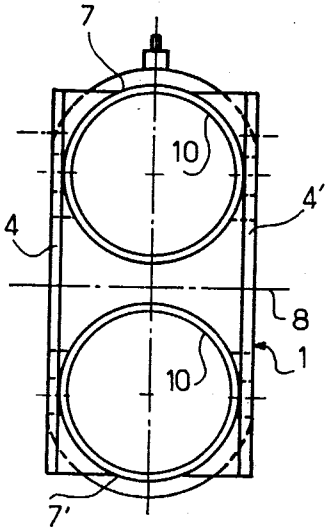
FIGS. 2 and 3 are end and top plan views, respectively, of the device shown in FIG. 1, and FIGS. 4 and 5 are end and side views, respectively, of a guide tube of the device shown in FIGS. 1 to 3.
Figure 4:
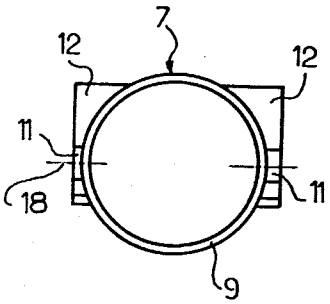
Figure 5:
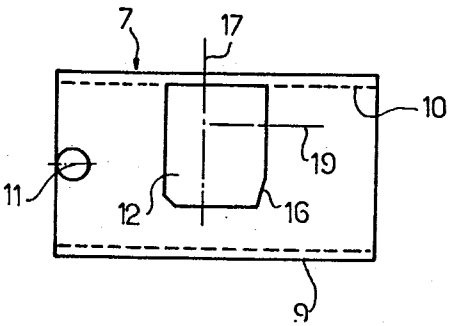
Figure 3:
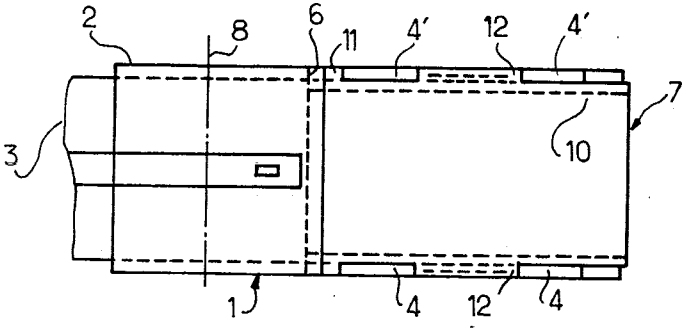

The device according to the invention includes a support frame, generally designated by reference numeral 1 and made for instance of steel and including a base 2 designed to be inserted in the end of barrels 3, and two parallel spaced flanges 4, 4' extending said base 2. In the embodiment illustrated, base 2 is bicylindrically shaped with parallel flat flanks and internally defines two parallel cylindrical chambers 5, adapted to receive the ends of twin barrels 3. The side walls of base 2 are extended in the forward direction by both parallel flanges 4 and 4', which are cut so as to define, at the level of cylindrical chamber 5 axle, semicylindrical bearing means 6 which act as hinges for guide tubes 7, 7'. Support frame 1 is firmly positionned on the ends of barrels 3, e.g. by means of a transversal securing screw sketched at 8.

Each tube 7, 7', made for instance out of tempered steel, includes a tubular part 9, defining a bore 10 identical to that of barrels 3, and on each side of said cylindrical part 9, a pair of opposed pivots 11 centered on the longitudinal axle of said cylindric part 9 and disposed near the tube end, and two opposed mounting blocks 12, laterally projecting at the level of the tube median part. In the assembled position of both tubes on support frame 1, pivots 11 are accomodated in bearing means 6, said mounting blocks 12 being received in housings cut in the intermediate portion of flanges 4, 4' and defining a seating bottom 13 connected to an orthogonal shoulder 14 by a curved part 15 corresponding to a rounded lower side portion 16 of blocks 12. A micrometer screw, figured at 17, associated with each block 12 allows the angle between the axle of cylindrical part 9 of tubes 7 and the axle of the corresponding barrel 3 to be changed within a limited range in a pivoting movement around axle 18 of pivots 11, illustrated by arrow X, both tube 7 and 7' being finally locked in the choosen angular position by locking screws passing through flanges 4, 4' and figured at 19.

While only a particular embodiment of the invention has been described and claimed herein, it is apparent that various modifications and alterations of the invention may be made.

It is therefore the intention in the appended claims to cover all such modifications and alterations as may fall within the true spirit and scope of the invention.

We claim:

1. A fire adjustment device, which comprises:

a gun barrel having a bore, a support frame, means for mounting said frame at the end of said barrel, at least one tube pivotally mounted around a pivot means on the frame in proximity to the end of said barrel and being adjustably positioned on said frame in alignment with said barrel by adjustment means, said tube having a bore similar to that of said barrel and defining an axis, adjusting means allowing the angle of the tube axis to be changed in relation to that of said barrel, wherein said support frame includes a base designed to be mounted on said barrel, and two spaced flanges, each flange defining bearing means for functioning as pivot elements of said tube, wherein said tube further includes a block laterally projecting on each side of said tube, and wherein each flange further includes a cut part defining a housing having a wall for accommodating said block laterally projecting from said tube.

2. The device of claim 1, wherein said adjusting means include a micrometer screw associated with at least a said block and cooperating with a said wall.

3. The device of claim 2, wherein it further includes locking means for locking said tube in an adjusted angular position in relation to said frame.

4. A fire adjustment device, which comprises:

a gun barrel having a bore, a support frame, means for mounting said frame at the end of said barrel, at least one tube pivotally mounted around a pivot means on the frame in proximity to the end of said barrel and being adjustably positioned on said frame in alignment with said barrel by adjustment means, said tube having a bore similar to that of said barrel and defining an axis and including a block laterally projecting therefrom, adjusting means allowing the angle of the tube axis to be changed in relation to that of said barrel, said support frame including two spaced flanges, each flange including a cut part defining a housing having a wall for accommodating said block, said adjusting means including a micrometer screw associated with at least said block and cooperating with said wall.

5. The device of claim 4, wherein it further includes locking means for locking said tube in an adjusted angular position in relation to said frame.

6. The device of any preceding claim for twin barrel gun, which includes two tubes symmetrically mounted on said support frame.

* * * * *